US012405098B2

(12) United States Patent
Liebenberg et al.

(10) Patent No.: US 12,405,098 B2
(45) Date of Patent: Sep. 2, 2025

(54) WIRELESS DETONATOR ARRANGEMENT

(71) Applicant: DETNET SOUTH AFRICA (PTY) LTD, Johannesburg (ZA)

(72) Inventors: Abraham Johannes Liebenberg, Johannesburg (ZA); Elmar Lennox Muller, Centurion (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 0 days.

(21) Appl. No.: 18/682,593

(22) PCT Filed: Jul. 7, 2022

(86) PCT No.: PCT/ZA2022/050029
§ 371 (c)(1),
(2) Date: Feb. 9, 2024

(87) PCT Pub. No.: WO2023/028621
PCT Pub. Date: Mar. 2, 2023

(65) Prior Publication Data

US 2025/0130027 A1 Apr. 24, 2025

(30) Foreign Application Priority Data

Aug. 24, 2021 (ZA) ..... 2021/06078

(51) Int. Cl.
*F42D 1/055* (2006.01)

(52) U.S. Cl.
CPC ..... *F42D 1/055* (2013.01)

(58) Field of Classification Search
CPC ..... F42D 1/045; F42D 1/05; F42D 1/055
USPC ..... 102/202.5, 202.9, 202.14
See application file for complete search history.

(56) References Cited

U.S. PATENT DOCUMENTS

| | | | | |
|---|---|---|---|---|
| 3,327,792 | A * | 6/1967 | Boop | E21B 43/117 175/4.54 |
| 5,263,416 | A * | 11/1993 | Amundson | F42B 5/105 102/443 |
| 5,531,164 | A * | 7/1996 | Mosley | F42D 1/055 102/312 |
| 9,709,373 | B2 | 7/2017 | Hikone et al. | |
| 11,874,098 | B2 | 1/2024 | Muller et al. | |
| 12,174,003 | B2 | 12/2024 | Muller et al. | |
| 2005/0178282 | A1 * | 8/2005 | Brooks | F42D 1/055 102/202.7 |

(Continued)

FOREIGN PATENT DOCUMENTS

| | | | |
|---|---|---|---|
| CA | 3215233 | A1 | 3/2023 |
| WO | 2012149277 | A2 | 11/2012 |

(Continued)

OTHER PUBLICATIONS

International Preliminary Report on Patentability for Application No. PCT/ZA2022/050029 dated Feb. 15, 2023 (8 pages).

(Continued)

*Primary Examiner* — Bret Hayes
(74) *Attorney, Agent, or Firm* — Michael Best & Friedrich LLP

(57) ABSTRACT

A wireless detonator arrangement wherein an initiator is positioned between a power supply and a housing which contains an explosive and through which extends conductors which connect a signal processor to the power supply and to the initiator.

4 Claims, 2 Drawing Sheets

(56) References Cited

U.S. PATENT DOCUMENTS

| | | | | |
|---|---|---|---|---|
| 2010/0212480 | A1 | 8/2010 | Bell | |
| 2020/0300593 | A1 * | 9/2020 | Sullivan | E21B 43/1185 |

FOREIGN PATENT DOCUMENTS

| | | | |
|---|---|---|---|
| WO | 2015199620 | A1 | 12/2015 |
| WO | 2021080513 | A1 | 4/2021 |

OTHER PUBLICATIONS

International Search Report and Written Opinion for Application No. PCT/ZA2022/050029 dated Oct. 10, 2022 (9 pages).

* cited by examiner

WIRELESS DETONATOR ARRANGEMENT

CROSS REFERENCE TO RELATED APPLICATIONS

This application is a U.S. National Phase application of International Patent Application No. PCT/ZA2022/050029 filed Jul. 7, 2022 which claims priority to South Africa Patent Application ZA 2021/06078 filed Aug. 24, 2021, the entire contents of both of which are herein incorporated by reference.

BACKGROUND OF THE INVENTION

This invention relates to a wireless detonator arrangement.

An arrangement of the aforementioned kind can be a bulky device. The arrangement requires a receiver which can receive electromagnetic command signals which travel, at times, through rock. An electrical supply is called for to power the receiver. Provision must be made for a processor to implement command signals relating to synchronisation and firing. An initiator, which may be in the form of a suitably configured detonator, is also required. Electrical energy is needed to ignite the initiator.

Certain applications also call for the detonator arrangement to be coupled in an effective manner to a booster which contains a secondary explosive.

To address the challenges relating to storage and transport a modular approach may be required so that hazardous components can be separated from non-hazardous components. This aspect mitigates against assembly of the detonator arrangement under factory conditions and, conversely, means that assembly on site by an operator, at a blast bench, should be readily effected in a safe and efficient way.

An object of the invention is to address the aforementioned requirement.

SUMMARY OF THE INVENTION

The invention provides a wireless detonator arrangement which includes an initiator, a first housing in which is mounted a power supply, a second housing which contains an explosive material, and a third housing which is engageable with a first end of the second housing and in which is mounted a signal processing assembly which includes a receiver and a processor for processing wireless signals received by the receiver, wherein the first housing is engageable with a second end of the second housing thereby to connect the power supply to the signal processing assembly via a conductive path which extends through the second housing from the first housing to the third housing, and wherein the signal processing assembly, responsive to a wireless fire command signal from a blast controller, causes ignition of the initiator.

Preferably the initiator is engageable with or is mounted in or to, at least the second housing.

The third housing may include a switch which is actuable manually or electrically to connect the power supply to the signal processing assembly.

BRIEF DESCRIPTION OF THE DRAWINGS

The invention is further described by way of example with reference to the accompanying drawings in which.

DESCRIPTION OF PREFERRED EMBODIMENT

Figure 1:
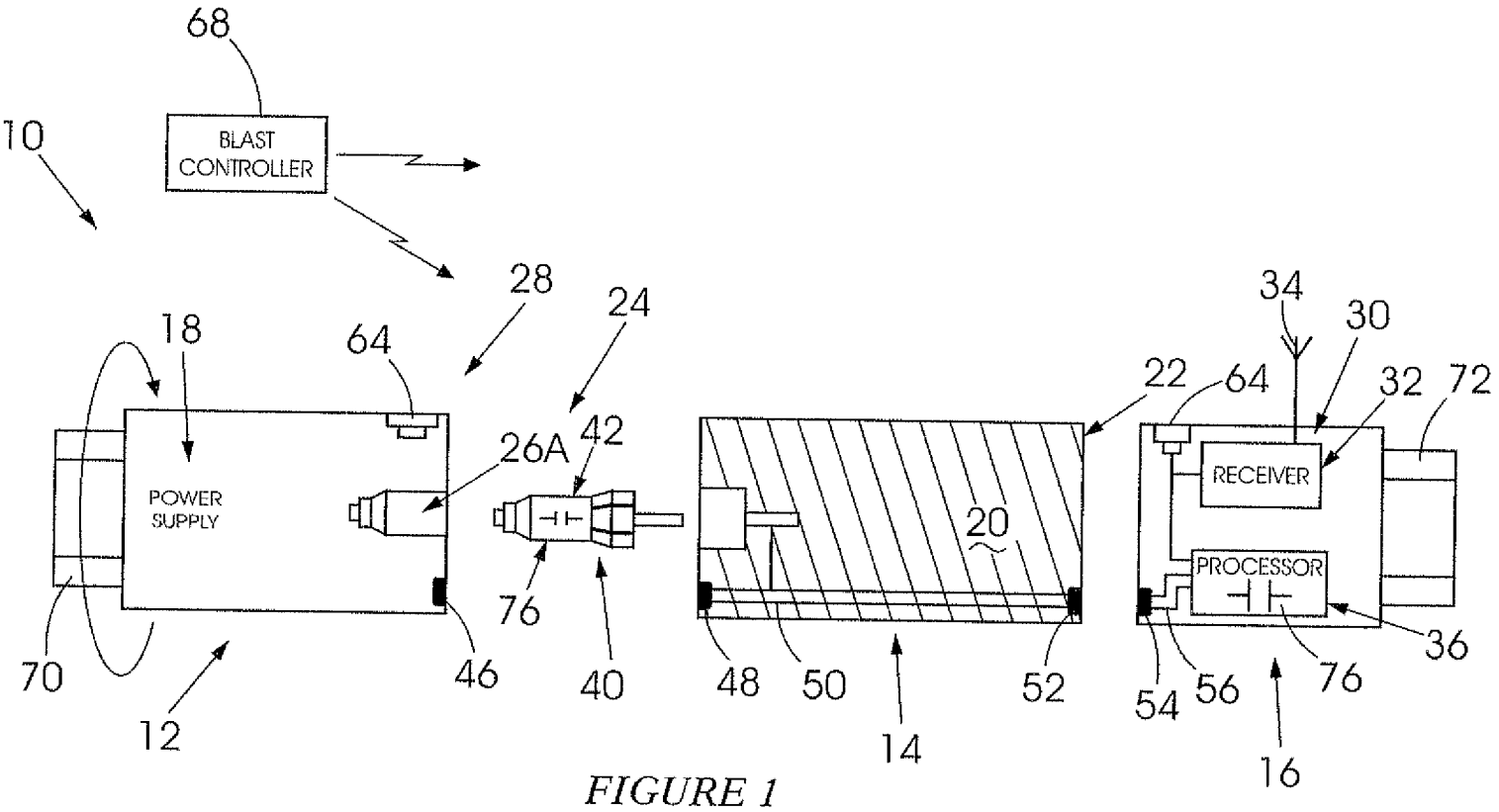
FIG. 1 shows a wireless detonator arrangement, according to the invention, in a disassembled state.
Figure 2:
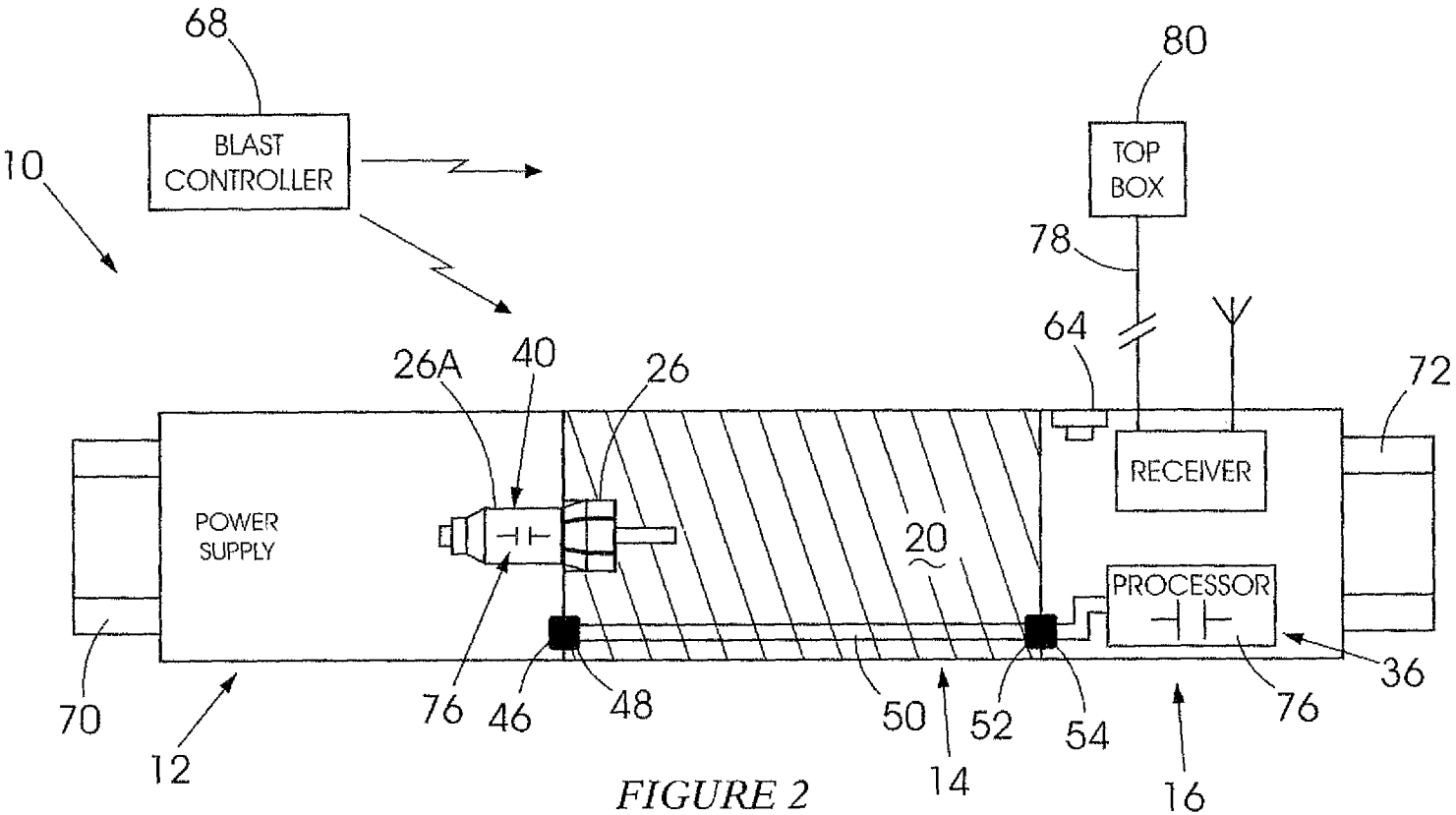
FIG. 2 depicts the wireless detonator arrangement of FIG. 1, fully assembled.

FIG. 1 of the accompanying drawings illustrates a wireless detonator arrangement 10, according to the invention, in a disassembled configuration. FIG. 2 shows the detonator arrangement 10 fully assembled.

The detonator arrangement 10 includes a first housing 12, a second housing 14 and a third housing 16.

Each housing is tubular and, depending on volume requirements, may be elongate.

The first housing 12 contains a battery power supply 18.

The second housing 14 contains a secondary explosive 20 and constitutes a booster. The second housing 14 has a first end 22 and a second end 24 in which is formed a recess 26 which faces a recess 26A in an end 28 of the first housing 12.

Mounted inside the third housing 16 is a signal processing assembly 30 which includes an electromagnetic communication signal receiver 32 which is coupled to a receiving antenna 34, and to a signal processor 36.

The arrangement 10 also includes an initiator 40 which, optionally, is mounted inside a casing 42.

The initiator 40 and the housing 14, which contains the explosive material 20, are hazardous goods. If these components are not connected to the first housing 12 nor to the third housing 16 then the housings 12 and 16 are not regarded as hazardous goods and can be transported and stored without taking into account regulations which apply to hazardous goods.

On site for assembly of the wireless detonator arrangement 10 an end of the initiator 40 is inserted into the recess 26. The first housing 12 is then physically engaged with the second housing 14 with a screw action which couples threads (not shown) on the first housing 12 with complementary threads on the second housing 14. An opposing end of the initiator then fits into the recess 26A. As an alternative to the screw action a bayonet-type fitting may be used to couple the housings physically to one another.

When the housings 12 and 14 are so coupled electrical contacts 46 on the first housing 12, which are electrically connected to the power supply 18, are brought into electrical connection with contacts 48 at the second end 24 of the second housing. These contacts 48 are electrically connected to conductors 50 which extend from the second end 24 to the first end 22 and which terminate in contacts 52 at the first end. The third housing 16 is similarly connected to the second housing 14, again using a thread action or a bayonet-type fitting. The contacts 52 are thereby then electrically connected to contacts 54 in the third housing 16. Electrical conductors 56 connect the contacts 54 to the signal processing assembly 30. Thus a conductive path is directly established from the power supply 18 to the signal processing assembly 30. To enhance and simplify electrical connectivity the contacts 48 and 52, say, could be of circular form i.e. similar to slip rings.

The fully assembled wireless detonator 10 is shown in FIG. 2.

A switch 64 which, in this embodiment, is on the third housing 16, is used to prevent the power source 18 from energising any of the electrical components until such time as operation is required, at site. As needed, at the time of deployment of the arrangement 10 at a blast bench, the switch 64 is turned on so that the power source 18 can then energise the receiver 32 and the processor 36 which, in turn, operating in response to a blast control signal, are used to trigger the initiator 40.

The switch 64 could be electronically controlled in that it is only operable when a signal, which preferably is encoded, from an external source, such as a blast controller 68, is received by the receiver 32. Thereafter the receiver 32 and the processor 36, using energy harvesting techniques whereby energy from a signal from the blast controller which is induced into coils (not shown), actuate the switch 64 and the power source 18 is then electrically connected to the processor 36 and to the receiver 32.

The housing 12 and the housing 16 have formations 70 and 72 at their respective free ends which can be used to suspend the assembled wireless detonator arrangement 10 from a cord, which goes to surface, at a desired location in a borehole.

In use of the initiating arrangement 10 a wireless command signal sent from the blast controller 68, which is at a remote location relative to the arrangement 10, is received by the antenna 34 and passed to the receiver 32. The processor 36 implements in a known manner any instruction contained in the command signal. The initiating arrangement 10 is usually first brought into synchronism with other similar initiating arrangements (not shown) in a blast system. Thereafter when a fire command signal is received by the receiver 32, the processor 36, after a pre-programmed timing delay interval, transmits a fire signal to the initiator 40 which causes ignition thereof. That in turn causes ignition of the explosive material 20.

Power for the sequence of operations is derived from the power supply 18 which energises the receiver 32 and the processor 36 through a conductive path formed by the abutting contacts 46 and 48, and 52 and 54, and the conductors 50 and 56.

Energy from the power supply 18 can be stored in one or more capacitors 76 in the initiator 40 or in the processor 36 or, possibly, in the initiator 40 and in the processor 36. This enables the initiator 40 and the processor 36 to function independently of the power supply 18 once a fire signal has been received e.g. to implement a programmed time delay and then to fire the detonator. This is beneficial in that a shock wave produced by a previously fired explosive could interrupt the connection of the power supply 18 to the processor 36.

Assembly of the arrangement on site at a blast bench is readily effected as the components are easily connected to one another. These components can only be connected in the manner shown—any attempt to connect the components to one another in a different way would not be successful.

The detonator arrangement 10 allows for use to be made of a substantially standard detonator in the initiator 40.

The initiator 40 and the housing 14, with the explosive 20, are kept separate from the first housing 12 and the third housing 16 until such time as on site assembly is required. This facilitates storage and transport requirements.

In a different system (FIG. 2) the arrangement 10 is suspended in a borehole from conductors 78 which are connected to a top-box 80 at a mouth of the borehole. The top-box 80 can communicate wirelessly with a blast controller, and via the conductors 78 with the arrangement 10, to control the blasting process.

The invention claimed is:

1. A wireless detonator arrangement (10) which includes an initiator (40), a first housing (12) in which is mounted a power supply (18), and contacts (46) connected to the power supply (18), a second housing (14) which contains an explosive material (20), contacts (52) at a first end (22) of the second housing (14), contacts (48) at a second end (24) of the second housing (14), and conductors (50) which extend from the contacts (48) to the contacts (52), and a third housing (16) which is engageable with the first end (22) of the second housing (14), a signal processing assembly (30) mounted inside the third housing (16), the signal processing assembly (30) including a receiver (32) and a processor (36) for processing wireless signals received by the receiver (32), and contacts (54) connected to the signal processing assembly (30), the first housing (12) being engageable with the second end (24) of the second housing (14) thereby to connect the power supply (18) to the signal processing assembly (30) via a conductive path comprising the contacts (46, 48), the conductors (50) and the contacts (52, 54), and wherein the signal processing assembly (30), responsive to a fire command signal, causes ignition of the initiator (40).

2. The wireless detonator arrangement (10) according to claim 1 wherein the initiator (40) is engageable with or is mounted in or to at least the second housing (14).

3. The wireless detonator arrangement (10) according to claim 1 wherein the third housing (16) includes a switch (64) which is actuable manually or electrically to connect the power supply (18) to the signal processing assembly (30).

4. The wireless detonator initiating arrangement (10) according to claim 1 which includes a capacitor (76) which is in at least one of the signal processing assembly (30) and the initiator (40) and which is operable to enable a firing sequence to be executed independently of the power supply (18) once said fire command signal has been received by the signal processing assembly (30).

* * * * *